US011124394B2

(12) United States Patent
Ou

(10) Patent No.: US 11,124,394 B2
(45) Date of Patent: Sep. 21, 2021

(54) CRANE

(71) Applicant: SUMITOMO HEAVY INDUSTRIES CONSTRUCTION CRANES CO., LTD., Tokyo (JP)

(72) Inventor: Ikushun Ou, Aichi (JP)

(73) Assignee: SUMITOMO HEAVY INDUSTRIES CONSTRUCTION CRANES CO., LTD., Tokyo (JP)

( * ) Notice: Subject to any disclaimer, the term of this patent is extended or adjusted under 35 U.S.C. 154(b) by 78 days.

(21) Appl. No.: 16/561,962

(22) Filed: Sep. 5, 2019

(65) Prior Publication Data

US 2019/0389702 A1 Dec. 26, 2019

Related U.S. Application Data

(63) Continuation of application No. PCT/JP2018/004497, filed on Feb. 8, 2018.

(30) Foreign Application Priority Data

Mar. 16, 2017 (JP) ..... JP2017-050768

(51) Int. Cl.
*B66D 1/38* (2006.01)
*B66C 23/36* (2006.01)

(52) U.S. Cl.
CPC ..... *B66D 1/38* (2013.01); *B66C 23/36* (2013.01)

(58) Field of Classification Search
CPC .. B66D 1/36; B66D 1/365; B66D 1/38; B66C 23/36
See application file for complete search history.

(56) References Cited

U.S. PATENT DOCUMENTS 524,619 A * 8/1894 Sturm ..... B66C 9/14 212/198
3,095,183 A * 6/1963 Bus, Sr. ..... B66D 1/36 254/272

(Continued)

FOREIGN PATENT DOCUMENTS

EP 2 281 771 A1 2/2011
JP H04-014287 U 2/1992

(Continued)

OTHER PUBLICATIONS

International Search Report issued in Application No. PCT/JP2018/004497, dated Mar. 27, 2018.

*Primary Examiner* — Michael E Gallion
(74) *Attorney, Agent, or Firm* — Michael Best & Friedrich LLP

(57) ABSTRACT

A crane includes a crane body, a boom, a hoisting winch, and a rope holding device pressing a rope wound around a drum of the hoisting winch against the drum. The rope holding device includes an oscillating arm whose proximal end is attached to a base of the hoisting winch using a support shaft and distal end oscillates in a direction close to or away from the drum, and a rope presser which is attached to a distal end of the oscillating arm, extends in an axial direction of the drum between a pair of flanges, and abuts against the rope wound around the drum. A weight member, which biases a distal end side of the oscillating arm in a direction close to the drum by the gravity with the support shaft as a fulcrum, is provided at the proximal end of the oscillating arm.

20 Claims, 9 Drawing Sheets

(56) References Cited

U.S. PATENT DOCUMENTS

| | | | | |
|---|---|---|---|---|
| 4,005,852 | A * | 2/1977 | Schmitmeyer | B66D 1/54 254/266 |
| 5,002,238 | A * | 3/1991 | Inhofer | B66D 1/36 242/156.1 |
| 9,248,999 | B2 * | 2/2016 | Xydias | B66D 1/36 |
| 9,908,756 | B2 * | 3/2018 | Heravi | B66D 1/46 |
| 10,336,590 | B2 * | 7/2019 | Hall | B66D 1/30 |
| 2008/0099421 | A1 * | 5/2008 | Pech | B66C 23/76 212/196 |
| 2008/0116161 | A1 * | 5/2008 | Kurotsu | B66C 23/82 212/262 |
| 2008/0203045 | A1 * | 8/2008 | Pech | B66C 23/76 212/270 |
| 2011/0031202 | A1 * | 2/2011 | Pech | B66C 23/76 212/178 |
| 2014/0091268 | A1 * | 4/2014 | Heravi | B66D 1/505 254/274 |
| 2015/0076266 | A1 * | 3/2015 | Crawford | B66D 1/38 242/156.1 |
| 2015/0284223 | A1 * | 10/2015 | Hall | B66D 1/22 254/333 |
| 2017/0107084 | A1 * | 4/2017 | Yu Date | B66C 13/18 |

FOREIGN PATENT DOCUMENTS

| | | | |
|---|---|---|---|
| JP | 2003-238082 | A | 8/2003 |
| JP | 2010-215336 | A | 9/2010 |
| JP | 2011-037634 | A | 2/2011 |

* cited by examiner

CRANE

RELATED APPLICATIONS

The contents of Japanese Patent Application No. 2017-050768, and of International Patent Application No. PCT/JP2018/004497, on the basis of each of which priority benefits are claimed in an accompanying application data sheet, are in their entirety incorporated herein by reference.

BACKGROUND

Technical Field

Certain embodiment of the present invention relates to a crane which is suitably used to transport a material to a high place at a construction site, for example.

Description of Related Art

In general, a crane used to transport a material to a high place at a construction site or the like includes a boom derricking winch which performs a derricking operation on a boom, a main winding winch which raises or lowers a hook suspended from a distal end of the boom, an auxiliary winding winch which raises or lowers an auxiliary hook suspended from a distal end of a jib, or the like. In addition, the crane (tower crane) having the jib on the distal end of the boom includes a jib derricking winch which performs a derricking operation on the jib.

A hoisting winch mounted on the crane includes a cylindrical drum and a hydraulic motor which rotationally drives the drum, the drum is rotated normally or reversely by the hydraulic motor, and thus, a rope such as a wire rope is wound or unwound around the drum. For example, the main winding winch winds or unwind a main winding rope around a main winding drum to raise or lower a hook provided at a distal end of the main winding rope, and thus, a cargo handling work is performed using this hook.

Here, in general, the rope wound around the drum is wound in a multilayer shape in a state where the rope is closely arranged in an axial direction of the drum. Meanwhile, in a case where the rope is loosened for some reasons, the rope may be not be wound in a state where the rope is arranged. In this case, the rope is irregularly wound, and thus, there is a concern that durability of the rope may decrease.

Meanwhile, in the related art, a hoisting winch which includes a rope holding device in order to suppress irregular winding of the rope around the drum is known. The rope holding device includes a presser roller which is disposed between a pair of flanges provided on both ends of a drum in an axial direction and a spring which biases the presser roller toward the drum. Moreover, a rope wound around the drum is pressed against the drumby the presser roller biased by the spring, and thus, loosening of the rope is suppressed, and the rope can be wound around the drum in a state where the rope is arranged.

SUMMARY

According to an embodiment of the present invention, there is provided a crane including: a crane body; a boom whose proximal end is attached to the crane body so as to perform a derricking operation; a hoisting winch which includes a base which is fixed to the boom, a drum which is rotatably provided in the base and around which a rope is wound, and a pair of flanges which is provided on both axial sides of the drum; and a rope holding device which presses the rope wound around the drum of the hoisting winch against the drum, in which the rope holding device includes an oscillating arm whose proximal end is attached to the base using a support shaft and distal end oscillates in a direction close to or away from the drum with the support shaft as a fulcrum, and a rope presser which is attached to a distal end of the oscillating arm, extends in an axial direction of the drum between the pair of flanges, and abuts against the rope wound around the drum.

DETAILED DESCRIPTION

A crane is known, in which a hoisting winch mounted on the crane is not only mounted on a crane body (vehicle body), but also a hoisting winch is mounted on a boom which can perform a derricking operation with respect to the crane body.

In the crane in which the hoisting winch is mounted on the boom, when the boom has a posture which is inclined with a relatively small angle with respect to the ground, a rope holding device can press a rope against a drum by a presser roller biased by the spring, and thus, the rope can be wound around the drum in a state where the rope is arranged.

However, when the boom has a posture (tower posture) which stands up to be substantially perpendicular to the ground, a moment in a direction away from the drum is generated in the presser roller. This moment acts in a direction opposite to a direction of a biasing force acting on the presser roller by the spring, and thus, a pressing force of the presser roller acting on the rope wound around the drum decreases. As a result, there is a problem that the rope cannot be wound around the drum in a state where the rope is arranged.

It is desirable to provide a crane capable of winding the rope around the drum of the hoisting winch mounted on the boom in a state where the rope is arranged, regardless of a posture of the boom.

A feature of the present invention is that a weight member, which biases a distal end side of an oscillating arm in a direction close to the drum by the gravity with a support shaft as a fulcrum, is provided at a proximal end of the oscillating arm.

According to the present invention, a moment with the support shaft as a fulcrum is generated in the oscillating arm by the weight member provided at the proximal end of the oscillating arm, and the distal end side of the oscillating arm can be biased in the direction close to the drum. Accordingly, the rope can be pressed against the drum by a rope presser attached to the distal end of the oscillating arm regardless of a posture of the boom performing a derricking operation with respect to the crane body, and the rope can be wound in a state where the rope is arranged on the drum.

Hereinafter, an embodiment of a crane according to the present invention will be described in detail with reference to FIGS. 1 to 9.

Figure 1:
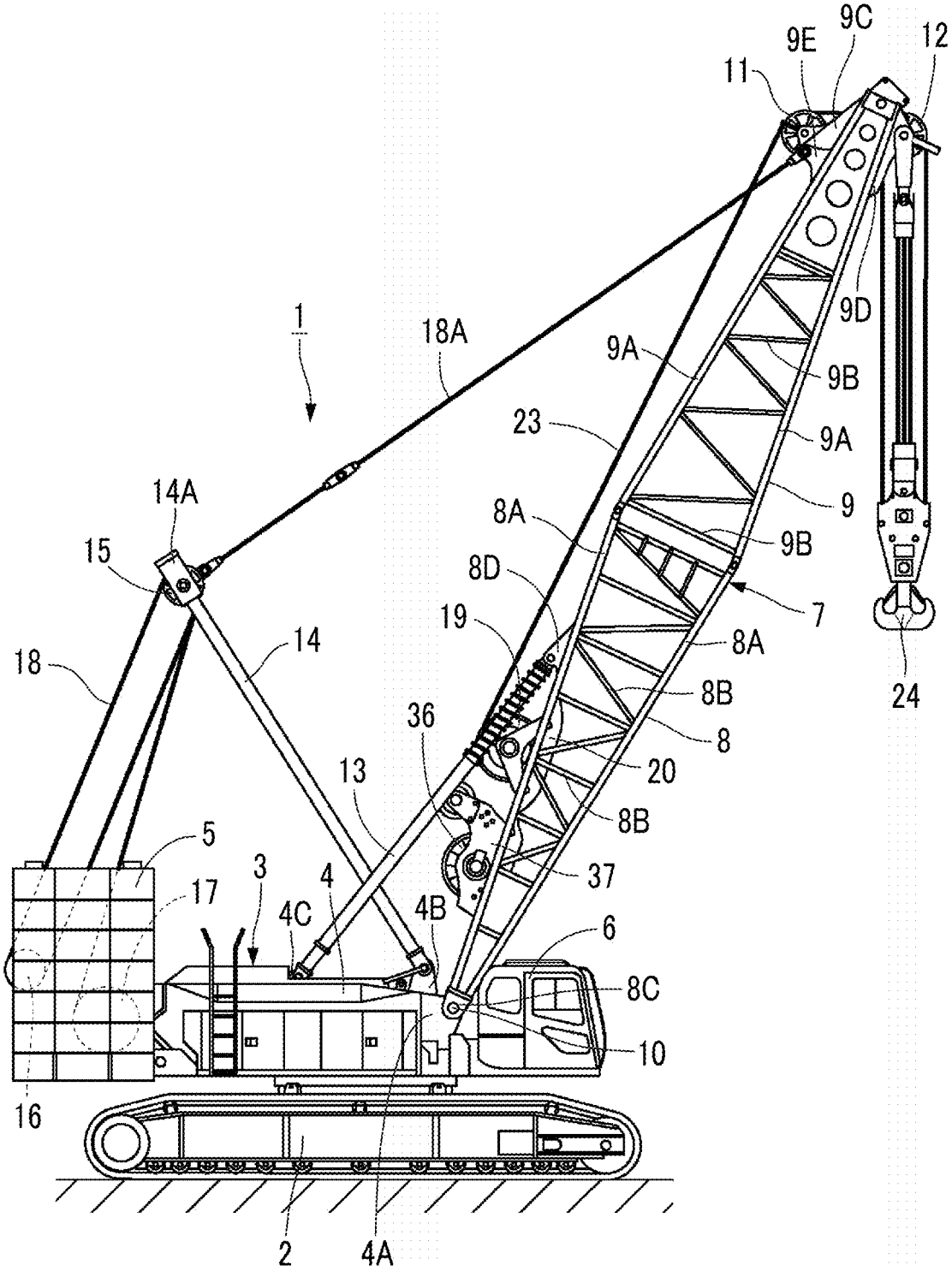
FIG. 1 is a front view showing a crane according to an embodiment of the present invention.

In FIG. 1, a crane 1 according to an embodiment is configured to include a self-propelled crawler type lower traveling body 2, an upper turning body 3 which is turnably mounted on the lower traveling body 2, and a boom 7 described later which is attached to a front side of the upper turning body so as to perform a derricking operation, and performs a cargo handling work using a hook 24 described later suspended from a distal end of the boom 7.

Here, the upper turning body 3 constitutes a crane body of the crane 1 and has a turning frame 4 which extends in forward and rearward directions. A boom attachment portion 4A is provided on a front side of the turning frame 4 and a proximal end of the boom 7 is attached to the boom attachment portion 4A so as to perform a derricking operation.

Moreover, a mast attachment portion 4B is provided behind the boom attachment portion 4A of the turning frame 4, and a proximal end of a mast 14 described later is rotatably attached to the mast attachment portion 4B. Furthermore, a backstop attachment portion 4C is provided behind the mast attachment portion 4B of the turning frame 4, and a proximal end of a backstop 13 described later is rotatably attached to the backstop attachment portion 4C.

A counterweight 5 is disposed behind the turning frame 4 to weight-balance the boom 7 and a hanging load. Further, a lower spreader 16 and a boom derricking winch 17 described later are disposed behind the turning frame 4 so as to be separated from each other in the front and rear. Meanwhile, a cab 6 is disposed on a right front side (a right side of the boom 7) of the turning frame 4 and a driver's seat and various operation devices (all not shown) are disposed in a driver's cabin defined by the cab 6.

The boom 7 is attached to the turning frame 4 of the upper turning body 3 so as to perform a derricking operation. Here, the boom 7 includes a lower boom 8 and an upper boom 9 connected to a distal end of the lower boom 8.

A proximal end bracket 8C is provided at a proximal end of the lower boom 8, and the proximal end bracket 8C is attached to the boom attachment portion 4A of the turning frame 4 via a pin 10 so as to perform a derricking operation. A backstop support bracket 8D is provided on a distal end side of the lower boom 8, and a distal end of the backstop 13 is attached to the backstop support bracket 8D. Moreover, a main winding winch 19 and an auxiliary winding winch 36 described later are mounted on the lower boom 8 so as to be arranged in a length direction.

Meanwhile, sheave brackets 9C and 9D are provided at a distal end of the upper boom 9. A guide sheave 11 is rotatably attached to the sheave bracket 9C, and a point sheave 12 is rotatably attached to the sheave bracket 9D. A main winding rope 23 described later is wound around the guide sheave 11 and the point sheave 12.

The backstop 13 is provided between the turning frame 4 and the boom 7. That is, a proximal end of the backstop 13 is attached to the backstop attachment portion 4C of the turning frame 4, and a distal end of the backstop 13 is attached to the backstop support bracket 8D of the lower boom 8. The backstop 13 is extended or shrunk in accordance with a derricking angle of the boom 7 and supports the upright standing boom 7 from behind when the boom 7 stands up to be substantially perpendicular to the ground.

The mast 14 is provided on the turning frame 4 so as to be rotatable in the forward and backward directions. That is, a proximal end of the mast 14 is rotatably pin-connected to the mast attachment portion 4B of the turning frame 4, and a distal end 14A of the mast 14 becomes a free end which can turn in the forward and backward directions with respect to the turning frame 4. The distal end 14A of the mast 14 and a pendant attachment portion 9E of the upper boom 9 are connected to each other via a pendant rope 18A. Further, an upper spreader 15 having a plurality of sheaves is provided on the distal end 14A of the mast 14.

Meanwhile, a lower spreader 16 and a boom derricking winch 17 are provided behind the turning frame 4. The lower spreader 16 has a plurality of sheaves corresponding to the respective sheaves of the upper spreader 15.

The boom derricking winch 17 winds and unwinds a boom derricking rope 18 to perform a derricking operation on the boom 7 via the mast 14. One end of the boom derricking rope 18 is wound around a drum of the boom derricking winch 17, and the other end thereof is wound around each sheave of the upper spreader 15 and each sheave of the lower spreader 16.

Figure 2:
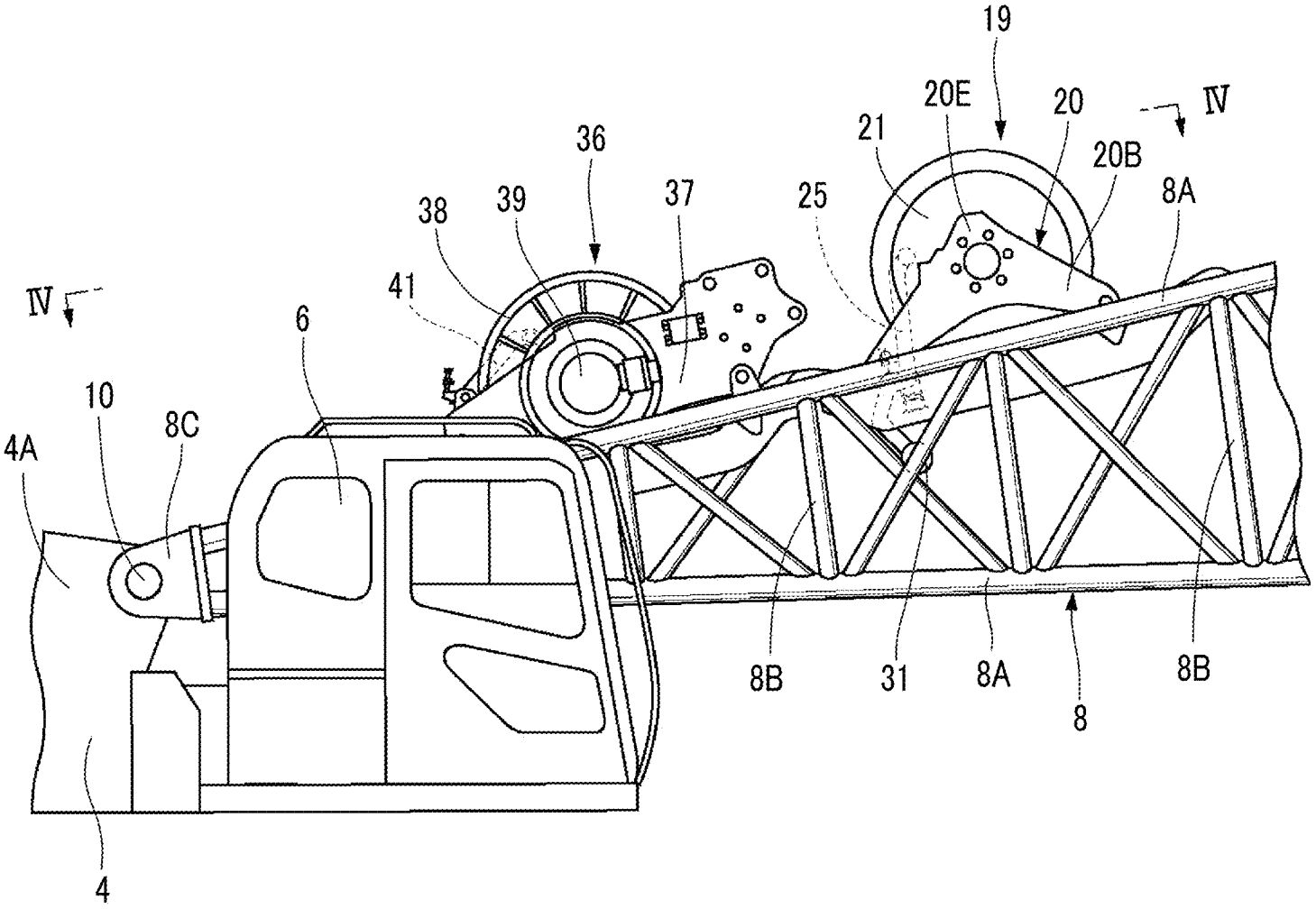
FIG. 2 is a front view showing state where a boom of the crane extends to be substantially horizontal to the ground.
Figure 3:
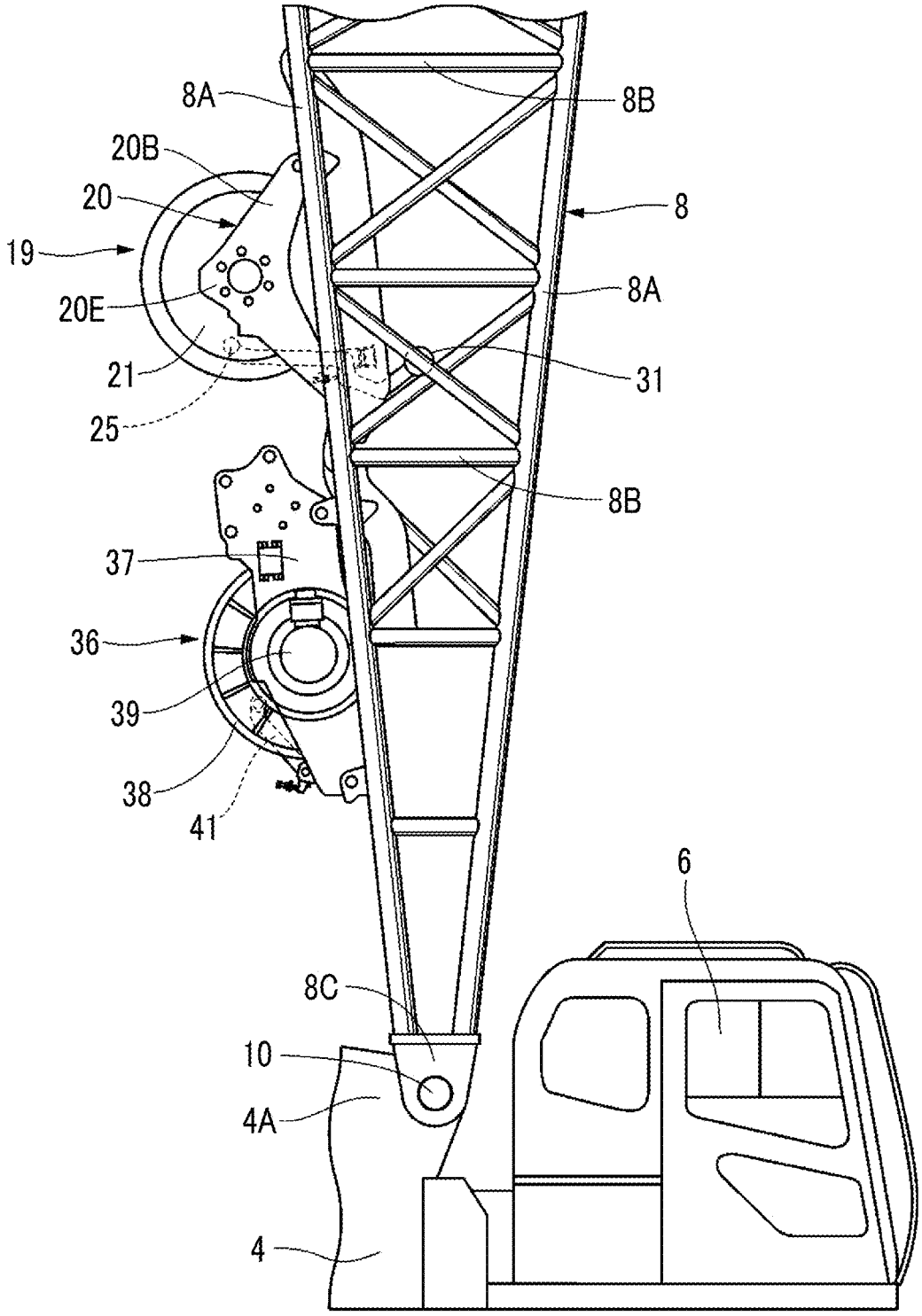
FIG. 3 is a front view showing state where the boom of the crane stands up to be substantially perpendicular to the ground.

Therefore, when the boom derricking rope 18 is wound by the boom derricking winch 17, the upper spreader 15 moves close to the lower spreader 16 and the distal end 14A of the mast 14 rotates rearward (toward a side of the counterweight 5). Meanwhile, when the boom derricking rope 18 is unwound from the boom derricking winch 17, the upper spreader 15 is separated from the lower spreader 16, and the distal end 14A of the mast 14 rotates forward (toward a side of the cab 6). In this way, the boom derricking rope 18 is wound or unwound by the boom derricking winch 17, and thus, the boom 7 can perform a derricking operation between a posture at which the boom 7 is inclined about the pin 10 with a relatively small angle to the ground as shown in FIG. 2 and a posture (tower posture) at which the boom 7 stands up to be substantially perpendicular to the ground as shown in FIG. 3.

Next, the main winding winch 19 and the rope holding device 25 used in the present embodiment will be described.

Figure 4:
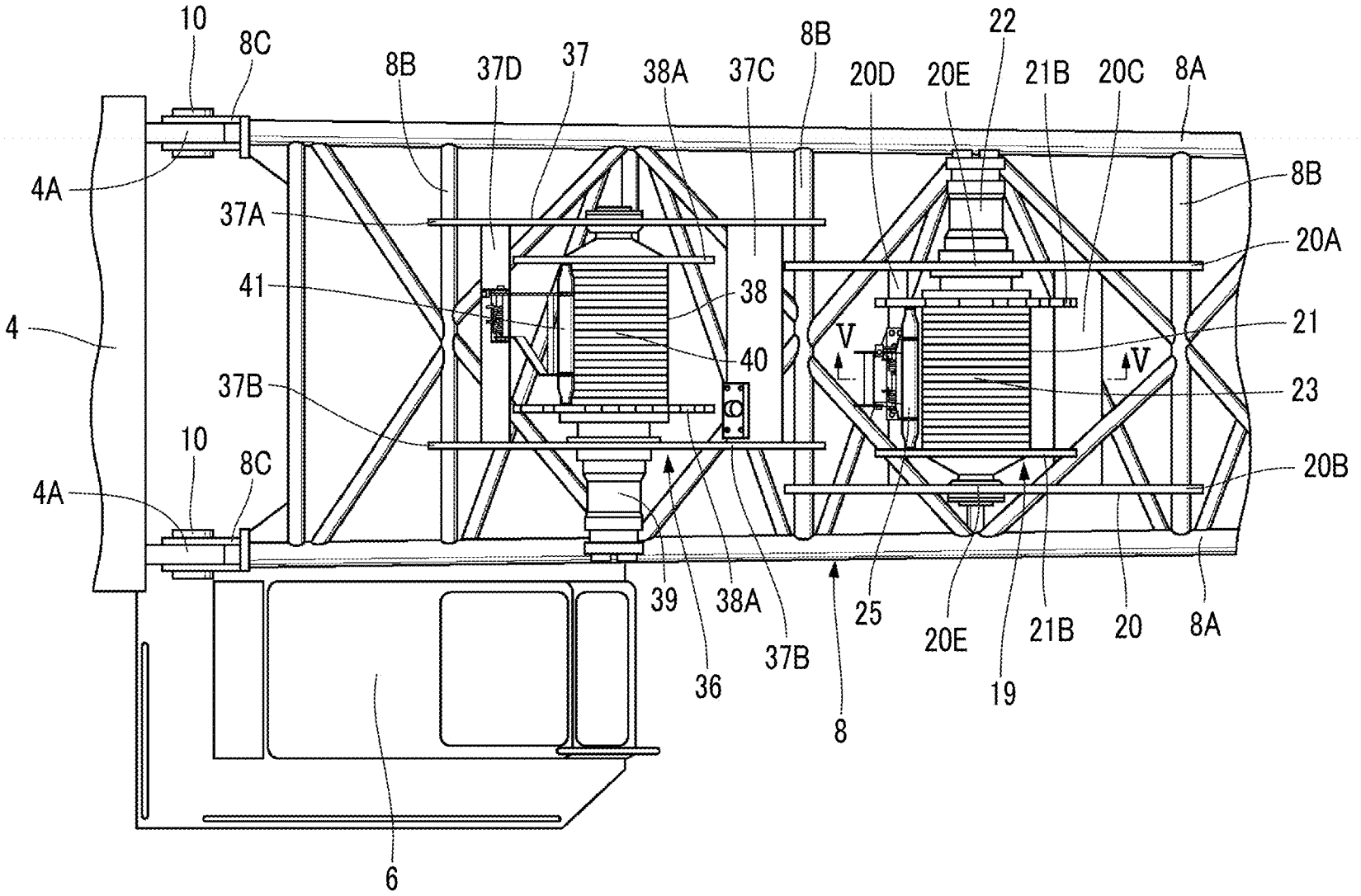
FIG. 4 is a plan view when a main winding winch, an auxiliary winding winch, or the like mounted on the boom is viewed in an arrow IV-IV direction in FIG. 2.

The main winding winch 19 is mounted on the lower boom 8 together with the auxiliary winding winch 36 described later. The main winding winch 19 constitutes a hoisting winch which winds and unwinds a main winding rope 23 described later. As shown in FIGS. 2 to 4, the main winding winch 19 is configured to include a base 20 described later, a main winding drum 21, and a hydraulic motor 22.

Figure 5:
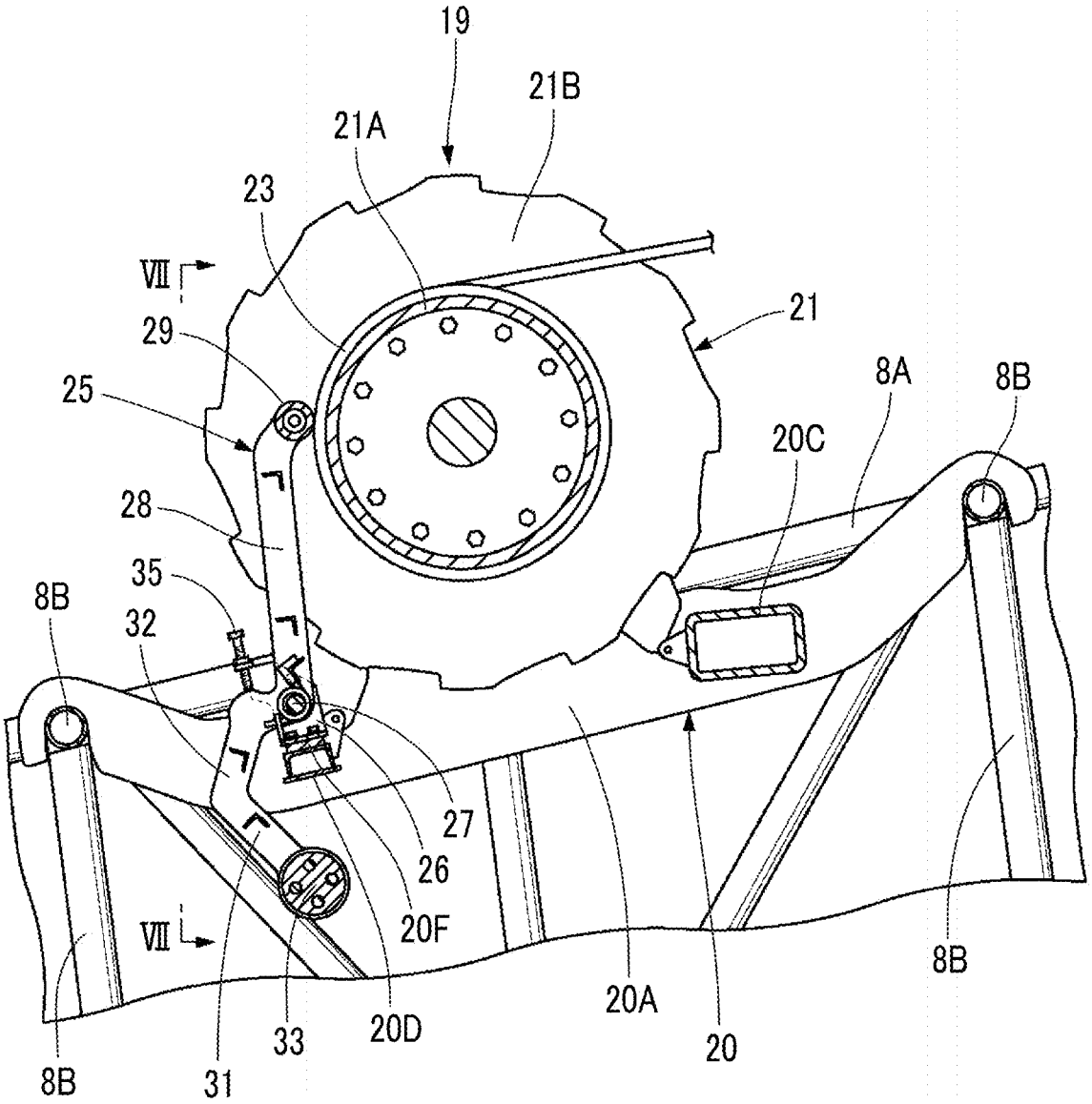
FIG. 5 is a cross sectional view when the main winding winch, a rope holding device, or the like is viewed in an arrow V-V direction in FIG. 4.

The base 20 is fixed to a beam 8B which connects the plurality of main members 8A constituting the lower boom 8 to each other by means of welding or the like. As shown in FIG. 4 and FIG. 5, the base 20 is formed in a substantially rectangular frame shape by a left base plate 20A and a right base plate 20B which are constituted by plates extending in a length direction of the lower boom 8 while facing each other with a gap in right and left directions, a wide connection member 20C which is constituted by a wide angular tubular body and connects the left and right base plates 20A and 20B to each other, and a narrow connection member 20D which is formed using a channel steel or the like having a width narrower than that of the wide connection member 20C and connects the left and right base plates 20A and 20B to each other. A central portion of each of the left and right base plates 20A and 20B in the length direction is a drum support portion 20E which protrudes in a mountain shape toward an outside of the lower boom 8 and the main winding drum 21 is supported by the drum support portion 20E. Moreover, a thick plate-shaped screw seat 20F is provided at a central portion of the narrow connection member 21D in the right and left directions, and the rope holding device 25 described later is attached to the screw seat 20F (refer to FIG. 6).

Figure 7:
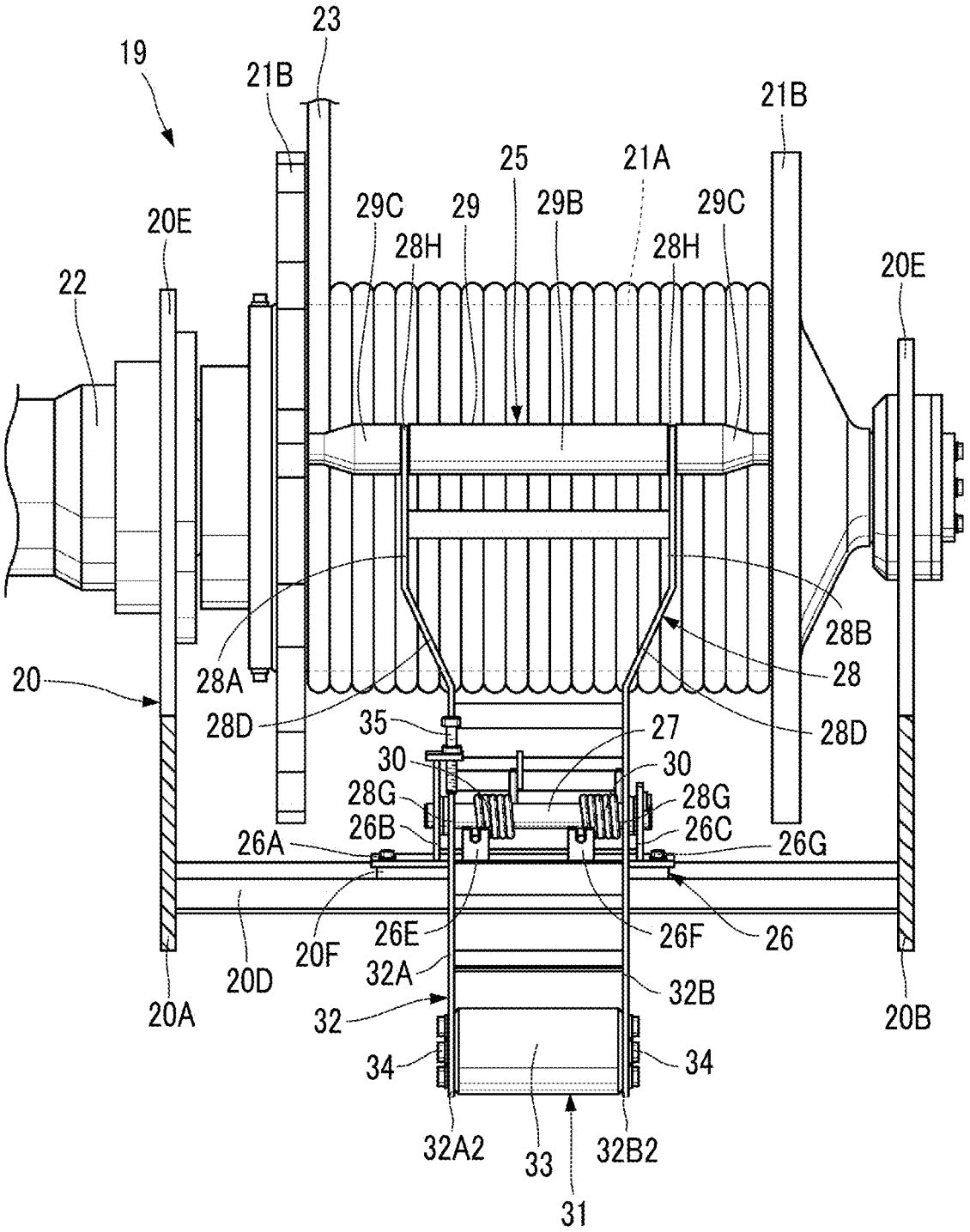
FIG. 7 is a main portion enlarged view when the main winding winch and the rope holding device are viewed in an arrow VII-VII direction in FIG. 5.
Figure 8:
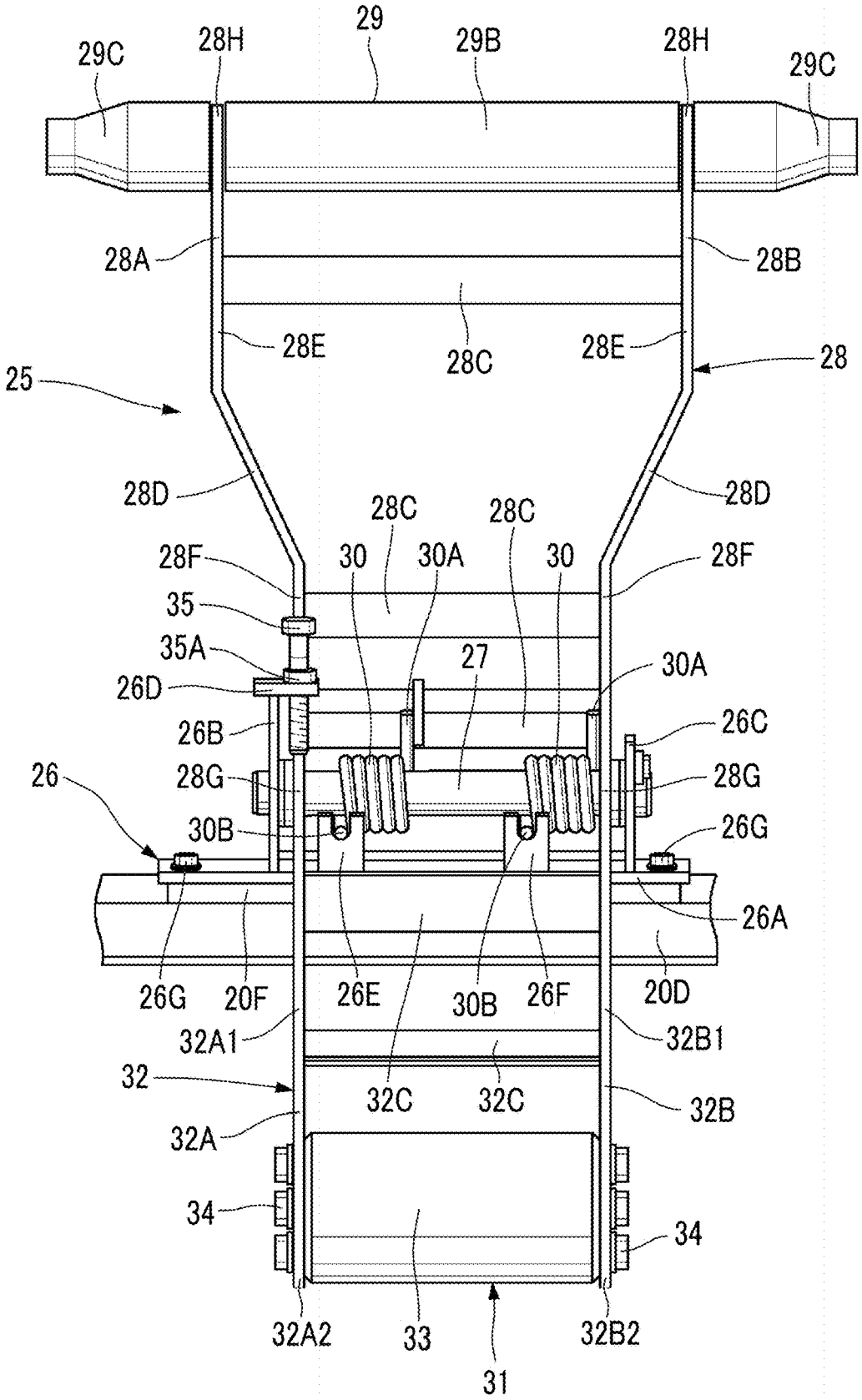
FIG. 8 is a main portion enlarged view showing the rope holding device in FIG. 7.

The main winding drum 21 is rotatably provided on the left and right base plates 20A and 20B constituting the base 20. As shown in FIG. 7, the main winding drum 21 is configured to have a cylindrical winding drum 21A whose axial center extends in the right and left directions between the left and right base plates 20A and 20B, and left and right flanges 21B, and left and right flanges 21B which are formed in a disk shape having a diameter larger than that of the winding drum 21A and are provided on axial both sides of the winding drum 21A. The main winding drum 21 is rotatably supported by the drum support portions 20E of the left and right base plates 20A and 20B constituting the base 20, via a bearing or the like, and winds and unwinds the main winding rope 23.

The hydraulic motor 22 is provided on a surface of the left base plate 20A constituting the base 20 opposite to the main winding drum 21. For example, the hydraulic motor 22 is rotated by pressure oil supplied from a hydraulic pump (not shown) mounted on the upper turning body 3. A rotation of the hydraulic motor 22 is decelerated by a reduction mechanism provided in the main winding drum 21, and the main winding drum 21 can rotate with a large torque. Moreover, for example, the main winding rope 23 can be wound around an outer peripheral surface of the winding drum 21A by rotating the main winding drum 21 in a normal direction by the hydraulic motor 22, and the main winding rope 23 can be unwound from the winding drum 21A by rotating the main winding drum 21 in a reverse direction.

The main winding rope 23 is wound around the main winding drum 21 of the main winding winch 19. One end side of the main winding rope 23 is wound around the winding drum 21A of the main winding drum 21, and the other end side of the main winding rope 23 is wound around the guide sheave 11 and the point sheave 12 provided on the distal end side of the upper boom 9, and thereafter, is attached to the hoisting hook 24. Therefore, the hook 24 can be raised and lowered by winding and unwinding the main winding rope 23 by the main winding winch 19. In addition, when the main winding rope 23 is wound around the main winding drum 21, the main winding rope 23 is wound in a multilayer shape in a state where the main winding rope 23 is closely arranged in an axial direction of the main winding drum 21 by the rope holding device 25 described later.

The rope holding device 25 is attached to the narrow connection member 20D which constitutes the base 20 of the main winding winch 19. The rope holding device 25 presses the main winding rope 23 wound around the main winding drum 21 of the main winding winch 19 against the winding drum 21A, and thus, prevents irregular winding of the main winding rope 23 with respect to the main winding drum 21. As shown in FIGS. 5 to 9, the rope holding device 25 is configured to include an attachment plate 26, a support shaft 27, an oscillating arm 28, a presser roller 29, and a weight member 31 described later.

Figure 6:
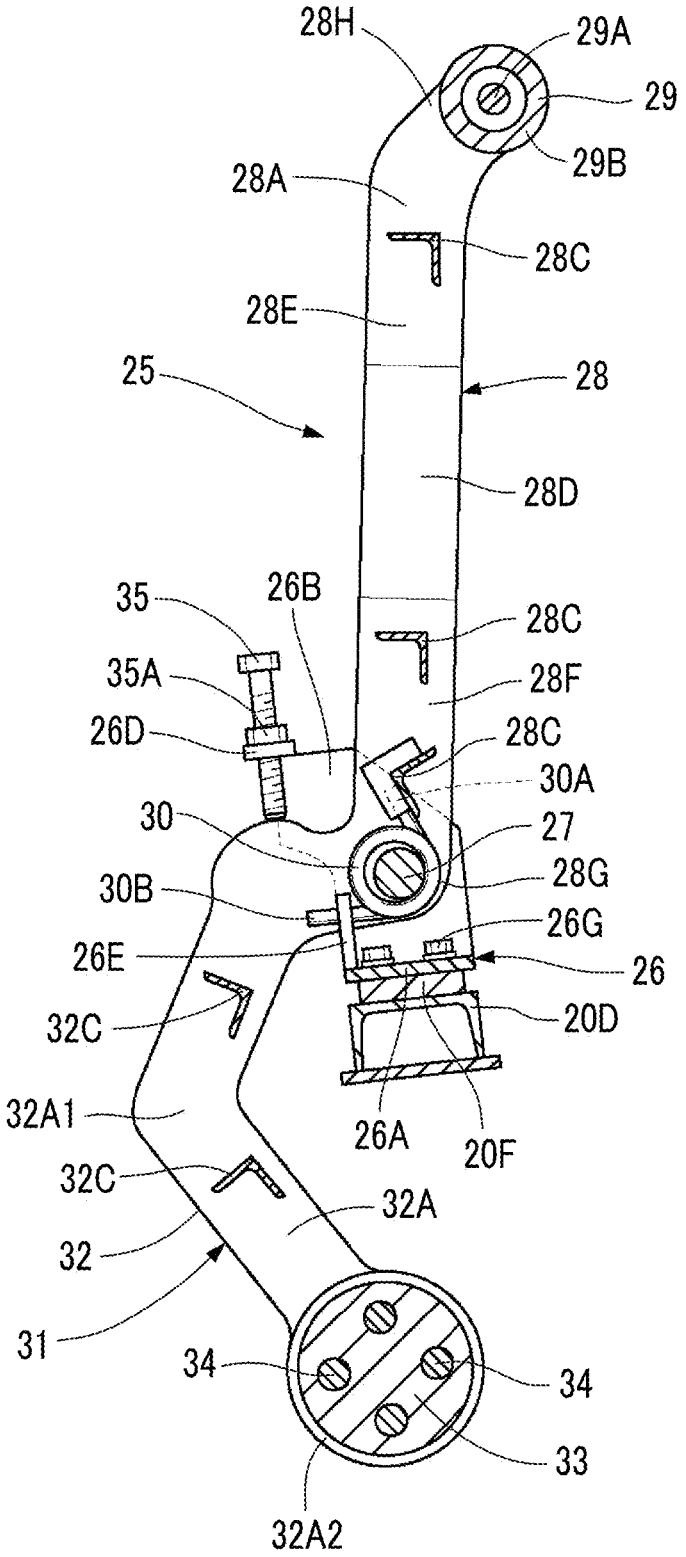
FIG. 6 is a main portion enlarged cross sectional view showing the rope holding device in FIG. 5.

The attachment plate 26 is attached to the screw seat 20F which is disposed at the center portion of the narrow connection member 20D. The attachment plate 26 includes a lower plate 26A which is constituted by a rectangular plate extending in the right and left directions, and a left vertical plate 26B and a right vertical plate 26C which are erected on the lower plate 26A and face each other with a gap in the right and left directions. As shown in FIGS. 5 and 6, a distal end of the left vertical plate 26B protrudes in a direction away from the main winding drum 21, and a stopper attachment plate 26D for attaching an arm stopper 35 described later is provided on a protruding end thereof. Further, spring receiving plates 26E and 26F for latching the other end 30B of a torsion spring 30 described later are provided between the left vertical plate 26B and the right vertical plate 26C. In addition, the lower plate 26A of the attachment plate 26 is attached to the screw seat 21F of the narrow connection member 21D using a bolt 26G.

The support shaft 27 is provided between the left vertical plate 26B and the right vertical plate 26C of the attachment plate 26 so as to extend in the right and left directions. For example, the support shaft 27 is constituted by a single shaft formed of a central round bar, is inserted into shaft insertion holes (not shown) formed in the left vertical plate 26B and the right vertical plate 26C, is supported by the left and right vertical plates 26B and 26C in a state in which the support shaft 27 is clamped and axially retained. The support shaft 27 supports the oscillating arm 28 such that the oscillating arm 28 can be oscillated and supports the torsion spring 30.

The oscillating arm 28 is attached to the base 20 of the main winding winch 19 using the support shaft 27 and can oscillate with the support shaft 27 as a fulcrum. The oscillating arm 28 is configured to include a left arm plate 28A and a right arm plate 28B which are constituted by plates extending in a direction orthogonal to the support shaft 27 and face each other with a gap in the right and left directions, and a plurality of (for example, three) connection members 28C which are constituted by plates having an L-shaped cross section and connect the left and right arm plates 28A and 28B to each other. A bending portion 28D is provided in an intermediate portion of each of the left and right arm plates 28A and 28B in the length direction, and the oscillating arm 28 has a wide portion 28E having a wide gap between the left and right arm plates 28A and 28B and a narrow portion 28F having a narrow gap between the left and right arm plates 28A and 28B with the bending portion 28D as a boundary portion.

Here, an extension arm portion 32 which constitutes the weight member 31 described later is integrally formed in the narrow portion 28F of the oscillating arm 28. That is, in the left and right arm plates 28A and 28B, a range connecting the support shaft 27 and the presser roller 29 to each other constitutes the oscillating arm 28. Meanwhile, a range which connects the support shaft 27 and a weight body 33 described later to each other constitutes the extension arm portion 32 of the weight member 31.

The support shaft 27 is inserted through proximal ends 28G of the narrow portion 28F of the oscillating arm 28, and the oscillating arm 28 is supported by the support shaft 27 so as to be oscillated. Therefore, each of distal ends 28H of the wide portion 28E of the oscillating arm 28 is a free end which oscillates in a direction close to or away from the main winding drum 21 with the support shaft 27 as a fulcrum. In addition, the presser roller 29 is attached to the distal ends 28H of the wide portion 28E of the oscillating arm 28.

The presser roller 29 is attached to the distal ends 28H of the wide portion 28E of the oscillating arm 28. The presser roller 29 constitutes a rope presser which abuts against the main winding rope 23 wound around the main winding drum 21. Here, the presser roller 29 is configured to include a roller shaft 29A (refer to FIG. 6) which is provided so as to penetrate the portion between the left and right arm plates 28A and 28B in the right and left directions, and a cylindrical roller body 29B which is rotatably attached to the roller shaft 29A via a bearing or the like (not shown).

The roller body 29B of the presser roller 29 is disposed between the left and right flanges 21B of the main winding drum 21, and extends in an axial direction of the main winding drum 21 over substantially the entire length of the winding drum 21A. The roller body 29B abuts against the main winding rope 23 wound around the winding drum 21A of the main winding drum 21 so that the main winding rope 23 is wound in a state where the main winding rope 23 is closely arranged in the axial direction of the winding drum 21A. In addition, both left and right ends 29C of the roller body 29B have a substantially truncated conical shape in order to prevent the main winding rope 23 wound around the main winding drum 21 from being irregularly wound in the vicinity of each flange 21B.

The left and right torsion springs 30 are provided one each (two in total) in the vicinity of the left and right arm plates 28A and 28B in a state where the torsion springs 30 are supported by the support shaft 27. Each of the left and right torsion springs 30 is constituted by a torsion coil spring, and a coil portion of each spring is inserted into an outer peripheral side of the support shaft 27. One end 30A of the torsion spring 30 on the left side (left arm plate 28A side) is latched to the connection member 28C of the oscillating arm 28, and the other end 30B thereof is latched to the spring receiving plate 26E of the attachment plate 26. Moreover, one end 30A of the torsion spring 30 on the right side (right arm plate 28B side) is latched to the connection member 28C of the oscillating arm 28 and the other end 30B thereof is latched to the spring receiving plate 26F of the attachment plate 26.

The left and right torsion springs 30 bias the oscillating arm 28 of the rope holding device 25 in a direction close to the main winding drum 21 with the support shaft 27 as a fulcrum, and apply an elastic pressing force with respect to the main winding rope 23 to the presser roller 29. Accordingly, the presser roller 29 presses the main winding rope 23 toward the winding drum 21A of the main winding drum 21, and prevents the irregular winding of the main winding rope 23 with respect to the main winding drum 21. That is, when the main winding rope 23 is wound around the winding drum 21A of the main winding drum 21, the presser roller 29 of the rope holding device 25 rotates about the roller shaft 29A while pressing the main winding rope 23 to the main winding drum 21 (winding drum 21A) by spring forces of the left and right torsion springs 30. Therefore, the main winding rope 23 is wound in a multilayer shape in a state where the main winding rope 23 is closely arranged on the winding drum 21A of the main winding drum 21.

Next, the weight member 31 used in the present embodiment will be described.

The weight member 31 is integrally provided with the proximal end 28G of the oscillating arm 28 which constitutes the rope holding device 25. The weight member 31 biases the distal end 28H of the oscillating arm 28 in the direction close to the main winding drum 21 by the gravity, with the support shaft 27 as a fulcrum. Here, the weight member 31 is configured to include the extension arm portion 32 and the weight body 33 described later.

The extension arm portion 32 is integrally formed with the proximal end 28G of the oscillating arm 28 and can oscillate together with the oscillating arm 28 using the support shaft 27 as a fulcrum. The extension arm portion 32 is configured to include a left extension arm plate 32A which is connected to the left arm plate 28A of the oscillating arm 28 and extends in a direction away from the presser roller 29 across the support shaft 27, a right extension arm plate 32B which is connected to the right arm plate 28B of the oscillating arm 28 and extends in the direction away from the presser roller 29 across the support shaft 27, and a plurality of (for example, two) connection members 32C which are constituted by plates having an L-shaped cross section and connect the left and right extension arm plates 32A and 32B to each other.

In an intermediate portion of the left extension arm plate 32A in a length direction thereof, a mountain-shaped bending portion 32A1 is provided to avoid an interference with the narrow connection member 20D constituting the base 20. Further, a disk-shaped weight attachment portion 32A2 is provided at a distal end of the left extension arm plate 32A, and a plurality of (for example, four) bolt insertion holes (not shown) penetrating the weight attachment portion 32A2 in a thickness direction are provided in the weight attachment portion 32A2. Similarly, a mountain-shaped bending portion 32B1 is provided in an intermediate portion of the right extension arm plate 32B in the length direction thereof, and a disk-shaped weight attachment portion 32B2 having a plurality of bolt insertion holes (not shown) penetrating the weight attachment portion 32B2 is provided at a distal end of the right extension arm plate 32B.

The weight body 33 constitutes a weight portion provided at the distal end of the extension arm portion 32. The weight body 33 is formed of a columnar weight having an axial dimension corresponding to a gap between the left and right extension arm plates 32A and 32B. A plurality of (for example, four) female screw holes (not shown) are formed on each of both axial end surfaces of the weight body 33, and bolts 34 inserted into the weight attachment portions 32A2 and 32B2 of left and right extension arm plates 32A and 32B are screwed into respective female screw holes of the weight body 33. Accordingly, the weight body 33 is detachably attached to the weight attachment portions 32A2 and 32B2 of the left and right extension arm plates 32A and 32B.

Figure 9:
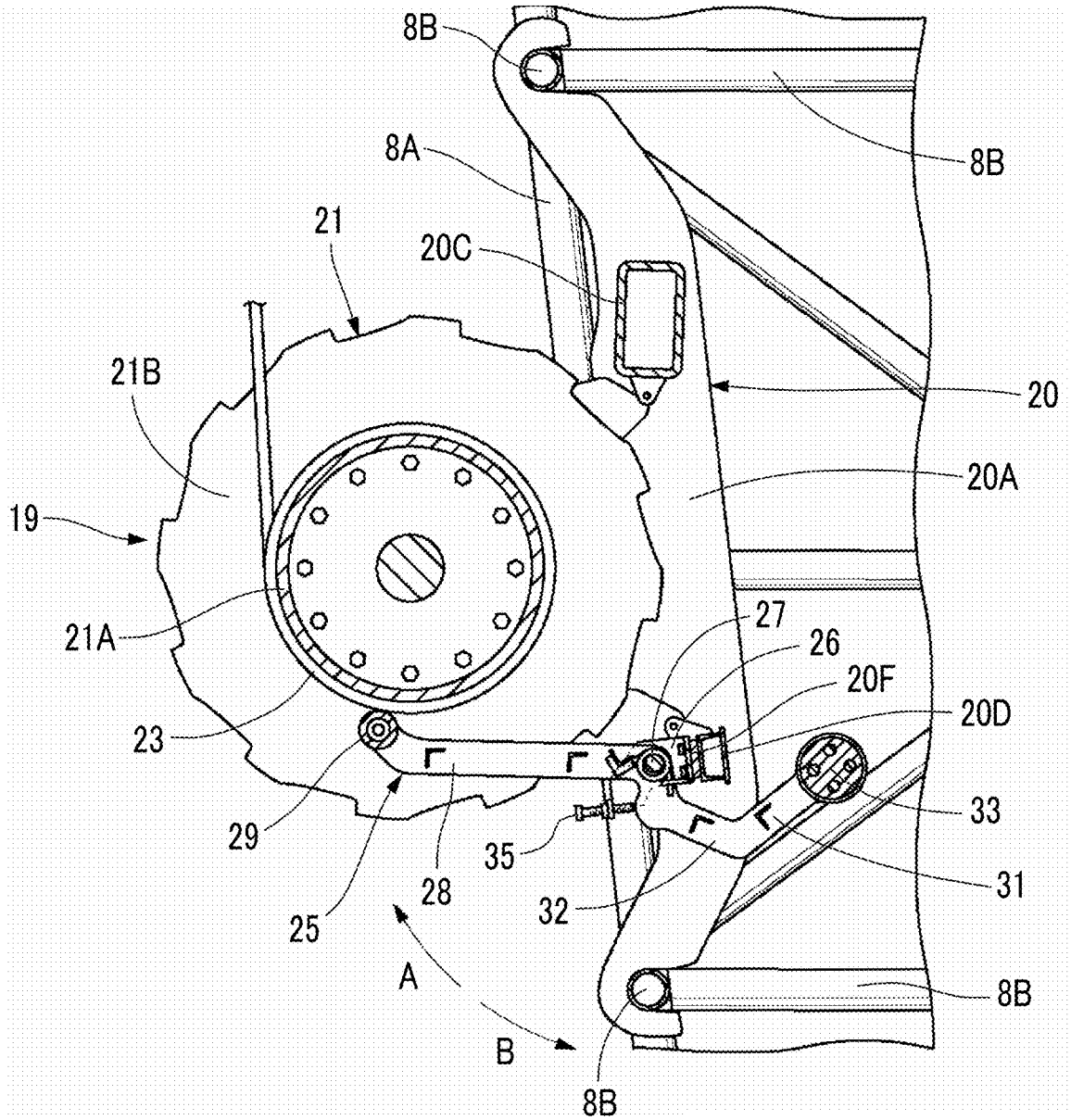
FIG. 9 is a cross sectional view at the same position as in FIG. 5 showing the main winding winch, the rope holding device, or the like in a state where the boom stands up.

In this way, in the rope holding device 25 according to the present embodiment, the extension arm portion 32 is integrally formed with the proximal end 28G of the oscillating arm 28, and the weight body 33 is attached to the distal end of the extension arm portion 32 extending in the direction away from the presser roller 29 across the support shaft 27. Thus, for example, as shown in FIG. 3 and FIG. 9, in a state where the boom 7 stands up, a moment in a direction (arrow A direction in FIG. 9) close to the main winding drum 21 with the support shaft 27 as a fulcrum is generated in the distal end 28H of the oscillating arm 28 having the presser roller 29, by the gravity acting on the weight member 31 including the extension arm portion 32 and the weight body 33.

As a result, even in the state where the boom 7 stands up, it is possible to press the presser roller 29 against the main winding rope 23 wound around the main winding drum 21 with the support shaft 27 as a fulcrum, by the gravity acting on the weight member 31 or the like, and it is possible to suppress the irregular winding of the main winding rope 23. In this case, a magnitude of the moment generated in the oscillating arm 28 can be set according to a length of the extension arm portion 32 and weight of the weight body 33, and thus, it is possible to appropriately adjust the pressing force of the presser roller 29 with respect to the main winding rope 23.

Here, the arm stopper 35 is attached to the stopper attachment plate 26D which constitutes the attachment plate 26 of the rope holding device 25. The arm stopper 35 is constituted by a bolt which is screwed into a female screw hole (not shown) formed in the stopper attachment plate 26D, and a distal end of the arm stopper 35 abuts against the left extension arm plate 32A. The arm stopper 35 is fixed to the stopper attachment plate 26D by a lock nut 35A. Therefore, by adjusting a protrusion length of the arm stopper 35 protruding from the stopper attachment plate 26D toward the left extension arm plate 32A, it is possible appropriately set a gap between the presser roller 29 and the winding drum 21A when the presser roller 29 provided at the distal end 28H of the oscillating arm 28 moves closest to the winding drum 21A of the main winding drum 21.

The auxiliary winding winch 36 is located between the pin 10 and the main winding winch 19 and is mounted on the lower boom 8. As shown in FIG. 4, approximately similarly to the main winding winch 19, the auxiliary winding winch 36 is configured to include a base 37 which is fixed to the plurality of beams 8B constituting the lower boom 8 and extends in the forward and rearward directions, a cylindrical auxiliary winding drum 38 which is rotatably attached to the base 37 and extends in the right and left directions, and a hydraulic motor 39 which rotationally drives the auxiliary winding drum 38. Disc-shaped flanges 38A are provided on both axial sides of the auxiliary winding drum 38, and an auxiliary winding rope 40 for suspending an auxiliary hook (not shown) is wound around an outer peripheral side of the auxiliary winding drum 38.

Here, the base 37 is formed in a substantially rectangular frame shape by left and right base plates 37A and 37B and a wide connection member 37C and a narrow connection member 37D connecting the left and right base plates 37A and 37B to each other. A rope holding device 41 for suppressing irregular winding of the auxiliary winding rope 40 by pressing the auxiliary winding rope 40 against the auxiliary winding drum 38 is provided in the narrow connection member 37D of the base 37.

The crane 1 according to the present embodiment has the configuration as described above, and next, an operation of the crane 1 is described.

When the cargo handling work is performed using the crane 1, for example, as shown in FIG. 1, the boom derricking rope 18 is wound by the boom derricking winch 17, and thus, the boom 7 is raised up about the pin 10 with respect to the turning frame 4.

In this state, the main winding drum 21 is rotated by the hydraulic motor 22 of the main winding winch 19. Accordingly, the main winding rope 23 can be wound around and unwound from the winding drum 21A of the main winding drum 21, and thus, the hook 24 can be raised or lowered, and a hanging load such as a material suspended from the hook 24 can be transported between the ground and a high location.

Here, when the main winding rope 23 is wound around the winding drum 21A of the main winding drum 21, for example, the main winding drum 21 is rotated in the normal direction by the hydraulic motor 22. Accordingly, the main winding rope 23 can be wound around the outer peripheral surface of the winding drum 21A. In this case, the distal end 28H of the oscillating arm 28 of the rope holding device 25 is biased in the direction close to the main winding drum 21 with the support shaft 27 as a fulcrum, by the spring forces of the torsion springs 30. Therefore, the presser roller 29 provided at the distal end 28H of the oscillating arm 28 abuts against the main winding rope 23 wound around the winding drum 21A of the main winding drum 21 and presses the main winding rope 23 against the outer peripheral surface of the winding drum 21A with an appropriate force while being rotated about the roller shaft 29A. As a result, the main winding rope 23 is not irregularly wound, and is wound in a multilayer shape in a state where the main winding rope 23 is closely arranged on the outer peripheral surface of the winding drum 21A.

Meanwhile, for example, as shown in FIG. 3 and FIG. 9, in a case where the boom 7 stands up so as to be substantially perpendicular to the ground, a moment in an arrow B direction in FIG. 9 (the direction in which the presser roller 29 moves away from the main winding drum 21) with the support shaft 27 as a fulcrum is generated in the oscillating arm 28, by the weight of the presser roller 29 or the like provided at the distal end 28H of the oscillating arm 28 Meanwhile, in the present embodiment, the extension arm portion 32 is integrally formed with the proximal end 28G of the oscillating arm 28, and the weight body 33 is attached to the distal end of the extension arm portion 32 extending in the direction away from the presser roller 29 across the support shaft 27.

Accordingly, in the state where the boom 7 stands up to be substantially perpendicular to the ground, the moment in a direction (arrow A direction in FIG. 9) close to the main winding drum 21 with the support shaft 27 as a fulcrum is generated in the distal end 28H of the oscillating arm 28 having the presser roller 29, by the gravity acting on the weight member 31 including the extension arm portion 32 and the weight body 33. Therefore, even in a case where the main winding rope 23 is wound around the main winding drum 21 in the state where the boom 7 stands up, it is possible to assist the torsion springs 30 by the gravity acting on the weight member 31 or the like, and it is possible to press the presser roller 29 against the main winding rope 23 wound around the main winding drum 21 with an appropriate force.

As a result, the main winding rope 23 can be pressed against the winding drum 21A of the main winding drum 21 by the presser roller 29 attached to the distal end 28H of the oscillating arm 28 regardless of the posture of the boom 7 performing the derricking operation with respect to the turning frame 4, and thus, the rope 23 can be wound in a multilayer shape in the state where the main winding rope 23 is closely arranged on the outer peripheral surface of the winding drum 21A.

Therefore, the crane 1 according to the present embodiment is configured to include the main winding winch 19 which includes the base 20 fixed to the lower boom 8 of the boom 7 and the main winding drum 21 around which the main winding rope 23 is wound, and the rope holding device 25 which presses the main winding rope 23 wound around the main winding drum 21 of the main winding winch 19 against the main winding drum 21, in which the rope holding device 25 is configured to include the oscillating arm 28 whose proximal end 28G is attached to the base 20 using the support shaft 27 and distal end 28H oscillates in the direction close to or away from the main winding drum 21 with the support shaft 27 as a fulcrum, and the presser roller 29 which is attached to the distal end 28H of the oscillating arm 28 and abuts against the main winding rope 23 wound around the main winding drum 21, and the weight member 31, which biases the distal end 28H of the oscillating arm 28 in the direction close to the main winding drum 21 by the gravity with the support shaft 27 as a fulcrum, is provided in the proximal end 28G of the oscillating arm 28.

Accordingly, the moment with the support shaft 27 as a fulcrum is generated in the oscillating arm 28 by the gravity acting on the weight member 31, and the distal end 28H of the oscillating arm 28 can be biased in the direction close to the main winding drum 21. Therefore, the main winding rope 23 can be pressed against the winding drum 21A of the main winding drum 21 by the presser roller 29 attached to the distal end 28H of the oscillating arm 28 regardless of the posture of the boom 7 performing the derricking operation with respect to the turning frame 4, and thus, the main winding rope 23 can be wound in the state where the main winding rope 23 is arranged on the main winding drum 21.

In this case, the weight member 31 is integrally provided with the oscillating arm 28 and rotatably supported by the support shaft 27. Accordingly, the weight member 31 oscillates integrally with the oscillating arm 28 with the support shaft 27 as a fulcrum, and thus, the presser roller 29 attached to the distal end 28H of the oscillating arm 28 abuts against the main winding rope 23 using the gravity acting on the weight member 31, and the main winding rope 23 can be pressed against the main winding drum 21 with an appropriate force.

Moreover, the weight member 31 is configured by the extension arm portion 32 which extends in the direction away from the presser roller 29 across the support shaft 27 and the weight body 33 which is provided on the distal end of the extension arm portion 32. Therefore, the magnitude of the moment generated in the oscillating arm 28 by the gravity acting on the weight body 33 can be set according to the length of the extension arm portion 32, and the pressing force of the presser roller 29 against the main winding rope 23 can be appropriately adjusted.

In addition, in the embodiment, the case is exemplified, in which the weight member 31 is provided in the rope holding device 25 which presses the main winding rope 23 against the main winding drum 21. However, the present invention is not limited to this. For example, the weight member may be provided in the rope holding device 41 which presses the auxiliary winding rope 40 against the auxiliary winding drum 38.

Moreover, in the embodiment, the case is exemplified, in which the left and right extension arm plates 32A and 32B constituting the extension arm portion 32 of the weight member 31 are respectively formed integrally with the proximal ends 28G of the left and right arm plates 28A and 28B constituting the oscillating arm 28 of the rope holding device 25. However, the present invention is not limited to this. For example, the left and right extension arm plates constituting the extension arm portion may be formed of members separated from the left and right arm plates constituting the oscillating arm, using bolts or the like, and may be detachably attached to the proximal ends of the left and right arm plates using a bolt or the like.

Moreover, in the embodiment, a case is exemplified, in which each of the torsion springs 30 is used as a spring for biasing the oscillating arm 28 of the rope holding device 25 in the direction close to the main winding drum 21. However, the present invention is not limited to this, and for example, a compression spring or a tension spring may be used. Further, in the embodiment, a case in which one torsion spring 30 is disposed in each of the right and left sides of the support shaft 27 is exemplified. However, the present invention is not limited to this. For example, only one spring may be disposed on the right side or the left side of the support shaft 27, one spring may be provided in a center and the left side of the support shaft 27, one spring may be provided in the center and the right side of the support shaft 27, and three or more springs may be disposed.

Moreover, in the present embodiment, the case in which the weight body 33 of the weight member 31 is formed in a columnar shape is exemplified. However, the present invention is not limited to this, and for example, the weight body 33 may be formed in a prismatic shape such as a square pole. Moreover, in the embodiment, the case in which the weight body 33 of the weight member 31 is detachably attached to the extension arm plates 32A and 32B using the bolt 34 is exemplified. However, the present invention is not limited to this, and for example, the weight body 33 may be fixed to the extension arm plates 32A and 32B by welding.

In addition, in the present embodiment, the crane 1 is exemplified, in which the hoisting winch such as the main winding winch 19 is mounted on the boom 7 (lower boom 8) and the main winding rope 23 to which the hook 24 is attached is suspended from the distal end of the boom 7 (upper boom 9). However, the present invention is not limited to this, and for example, the present invention can be applied to other cranes such as a tower crane in which a jib is attached to a distal end of a boom so as to perform a derricking operation and a hoisting winch is mounted on the boom.

It should be understood that the invention is not limited to the above-described embodiment, but may be modified into various forms on the basis of the spirit of the invention. Additionally, the modifications are included in the scope of the invention.

What is claimed is:

1. A crane comprising:

a crane body;

a boom whose proximal end is attached to the crane body so as to perform a derricking operation;

a hoisting winch which comprises:

a base which is fixed to the boom, a drum which is rotatably provided in the base and around which a rope is wound, and a pair of flanges which is provided on both axial sides of the drum; and a rope holding device which presses the rope wound around the drum of the hoisting winch against the drum, wherein the rope holding device comprises:

an oscillating arm whose proximal end is attached to the base using a support shaft and distal end oscillates in a direction toward or away from the drum with the support shaft as a fulcrum, and a rope presser which is attached to a distal end of the oscillating arm, extends in an axial direction of the drum between the pair of flanges, and abuts against the rope wound around the drum, and wherein a weight member is provided at the proximal end of the oscillating arm so that gravity applied to the weight member biases the distal end of the oscillating arm in a direction toward the drum with the support shaft as a fulcrum.

2. The crane according to claim 1, wherein the weight member is integrally provided with the oscillating arm and is rotatably supported by the support shaft.

3. The crane according to claim 1,
wherein the weight member includes an extension arm portion which extends in a direction away from the rope presser across the support shaft and a weight portion which is provided on a distal end of the extension arm portion.

4. The crane according to claim 1, further comprising:
a bias unit which presses the oscillating arm in the direction toward the drum regardless of a posture of the boom.

5. The crane according to claim 4,
wherein the gravity applied to the weight member biases the distal end side of the oscillating arm in the direction toward the drum with the support shaft as a fulcrum as the boom stands up.

6. The crane according to claim 1, further comprising:
a stopper which regulates a rotation of the oscillating arm in the direction toward the drum.

7. The crane according to claim 6,
wherein the stopper is configured to adjust a gap between a presser roller and a winding drum in a case where the stopper regulates the rotation of the oscillating arm in the direction toward the drum.

8. The crane according to claim 7,
wherein the stopper includes a protrusion portion which protrudes toward the oscillating arm, and adjusts the gap by adjusting a protruding length of the protrusion portion.

9. The crane according to claim 8,
wherein the protrusion portion is a bolt, and the gap is adjusted by screwing the bolt.

10. The crane according to claim 8,
wherein the protrusion portion is located on an upper side of the boom with respect to the weight member.

11. The crane according to claim 6,
wherein the oscillating arm includes a pair of left and right oscillating arms.

12. The crane according to claim 11,
wherein the stopper is arranged in one of the pair of the oscillating arms.

13. The crane according to claim 1,
wherein the weight member includes an extension arm portion which extends in a direction away from the rope presser across the support shaft and a weight portion which is provided on a side of the extension arm portion opposite to the support shaft.

14. The crane according to claim 13,
wherein the weight portion is arranged at a position opposite to the oscillating arm with the support shaft interposed therebetween and overlapping the support shaft when viewed from the oscillating arm.

15. The crane according to claim 14,
wherein the extension arm portion includes a bending portion which extends in a direction away from the base, the bending portion being arranged at a position opposite to the oscillating arm with the support shaft interposed therebetween and not overlapping the support shaft when viewed from the oscillating arm.

16. The crane according to claim 15,
wherein the base includes a pair of a left base plate and a right base plate which extend in a length direction of the boom and a connection member which connects the left and right base plates to each other.

17. The crane according to claim 16,
wherein the extension arm portion includes a bending portion which extends in a direction away from the connection member, the bending portion being arranged at a position opposite to the oscillating arm with the support shaft interposed therebetween and not overlapping the support shaft when viewed from the oscillating arm.

18. The crane according to claim 13,
wherein the extension arm portion includes a pair of a left extension arm plate and a right extension arm plate and a connection member which connects the left and right extension arm plates to each other.

19. The crane according to claim 1,
wherein the weight member includes an extension arm portion which extends in a direction away from the rope presser across the support shaft and a weight portion which is provided on a side of the extension arm portion opposite to the support shaft.

20. The crane according to claim 19,
wherein the weight portion is detachably fixed to the extension arm portion by a bolt.

* * * * *